US005492238A

United States Patent [19]

Scholl et al.

[11] Patent Number: 5,492,238

[45] Date of Patent: Feb. 20, 1996

[54] ARRANGEMENT WITH A WASTE CONTAINER, A COVER THEREFOR, AND A COVER OPENING MECHANISM FOR HOUSEHOLD AND SANITARY APPLICATIONS

[75] Inventors: Winfried Scholl, Düsseldorf; Stefan Pickert, Baunatal; Karl-Heinz Büchsenschütz, Warburg, all of Germany

[73] Assignee: Heinrich Wilke GmbH, Arolsen, Germany

[21] Appl. No.: 182,658

[22] Filed: Jan. 18, 1994

[30] Foreign Application Priority Data

Jan. 15, 1993 [DE] Germany ..... 43 00 998.0

[51] Int. Cl.[6] ..... B65D 43/26; B65F 1/00

[52] U.S. Cl. ..... 220/263; 220/260; 220/751; 220/908; 248/147

[58] Field of Search ..... 220/3.3, 3.8, 3.9, 220/478, 481, 908, 260, 263, 628, 262, 631, 751, 338; 248/95, 134, 147

[56] References Cited

U.S. PATENT DOCUMENTS

| | | | |
|---|---|---|---|
| 1,485,496 | 11/1922 | Elliott | 248/134 |
| 1,594,535 | 1/1926 | Lindbeck | 220/478 |
| 2,427,335 | 9/1947 | Antonia et al. | 220/478 X |
| 2,754,991 | 7/1952 | Hagerty | 220/481 |
| 3,383,035 | 12/1966 | Smithers | 248/134 |
| 4,776,480 | 10/1988 | Triadu et al. | 220/478 |

FOREIGN PATENT DOCUMENTS

| | | |
|---|---|---|
| 3400153 | 7/1985 | Germany . |
| 4101285 | 7/1992 | Germany . |
| 6905006 | 10/1970 | Netherlands . |
| 9000192 | 8/1991 | Netherlands . |

*Primary Examiner*—Gary E. Elkins
*Assistant Examiner*—Nathan J. Newhouse
*Attorney, Agent, or Firm*—Michael J. Striker

[57] ABSTRACT

An arrangement for storing wastes for household and sanitary applications has a waste container, a cover for closing the waste container, a cover opening mechanism, and an understructure which is mountable on a wall and other element and formed so that the waste container is supported on the understructure turnably so that a turning of the waste container leads to an opening of the cover.

9 Claims, 9 Drawing Sheets

ARRANGEMENT WITH A WASTE CONTAINER, A COVER THEREFOR, AND A COVER OPENING MECHANISM FOR HOUSEHOLD AND SANITARY APPLICATIONS

BACKGROUND OF THE INVENTION

The present invention relates to arrangements with a waste containers, as well as to a cover therefor, and a cover opening mechanism, for household and sanitary applications.

In known arrangements of this type which are usually utilized in household or in public buildings and in particular in bathrooms, water closets, kitchens and the like, the opening mechanisms has at least one foot pedal which acts through a rod or the like onto the container cover. Such openings mechanisms are susceptible to troubles and frequently difficult to operate since the whole arrangement as a rule is easily displaceable on the ground and not always occupies such location in which an easy access to the foot pedal is possible. In addition, the foot pedal and/or the rod easily band during use, whereby the opening mechanism becomes inoperative. As a result, the arrangements having waste containers which are provided with covers and are, therefore, preferred for hygienic reasons become frequently inoperative, which especially in hospitals, schools, swimming pools, etc. is very disturbing.

SUMMARY OF THE INVENTION

Accordingly, it is an object of the present invention to provide an arrangement of the above mentioned general type, which can be fixed in bathrooms, water closets, etc., on an exactly predetermined location and whose opening mechanism is structurally simple and therefore less trouble susceptible.

In keeping with these objects and with others which will become apparent hereinafter, one feature of the present invention resides, briefly stated, in an arrangement with a waste container, a cover therefor and a cover opening mechanism for household and sanitary applications, in which the waste container is supported turnably in an understructure mountable on a wall or the like so that its turning leads to an opening of the cover.

When the arrangement is designed in accordance with the present invention, it has the advantage that the waste container can be brought to a position required for opening of the cover by a turning movement provided with a hand or a knee. Therefore it is possible to perform the opening movement with simple wedge or slide surfaces, so that a simple and stable construction is provided.

In accordance with another feature of the present invention, the cover is also turnable in the understructure, and the waste container is provided with at least one actuating element for turning the cover. The cover can be provided with a sliding surface cooperating with the actuating element. It can also have at least one abutment which limits the opening movement of the cover during its turning.

The waste container can be provided at its rear side with holding webs which are guided during the turning of the waste container in guides of the understructure. The ends of the holding webs can have associated carrying arms, in which holding lugs mounted on the holding webs are suspended. The holding lugs can be formed at the rear end with inclinedly extending guiding surfaces which are guided on the guiding projections of the supporting arms so that the waste container is lifted during its turning. The upper ends of the holding webs can be provided with guiding webs which are displaceably guided in U-shaped and downwardly open cutouts of the arms of the understructure.

In accordance with still a further feature of the present invention the understructure is provided with a cover cap. The cover cap can have slots for lateral guidance of the holding webs in the understructure. The understructure can be further provided with an anti-theft securing element which is mounted on a springing tongue and is arrestable in a slot of the associated holding web. The cover cap can have an opening for removing the anti-theft securing element from the slot.

The bottom, the intermediate walls, and the front wall of the cover cap can together limit a supply container. An additional cover can be provided for the supply container and turnably supported on the understructure.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
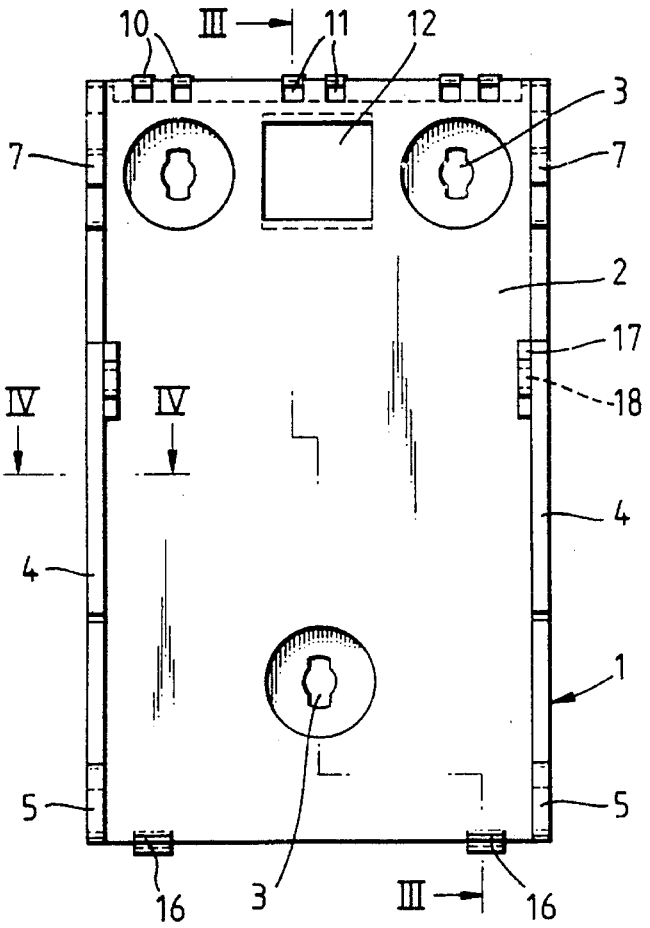
FIG. 1 is a front view of an understructure of an arrangement in accordance with the present invention.
Figure 3:
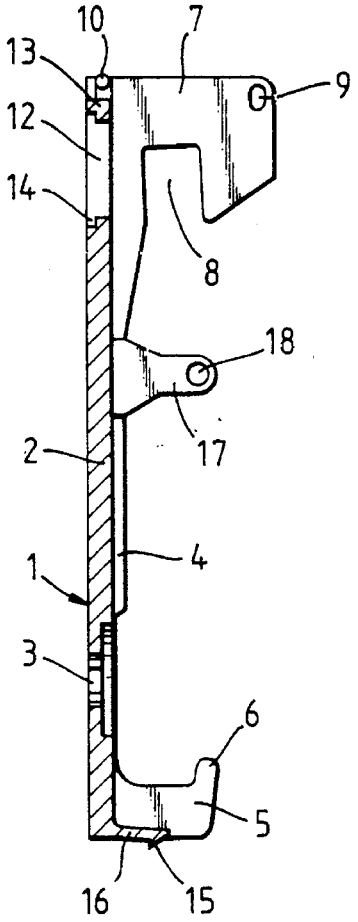
FIG. 3 is a view showing a section taken along the line III—III in FIG. 1.
Figure 2:
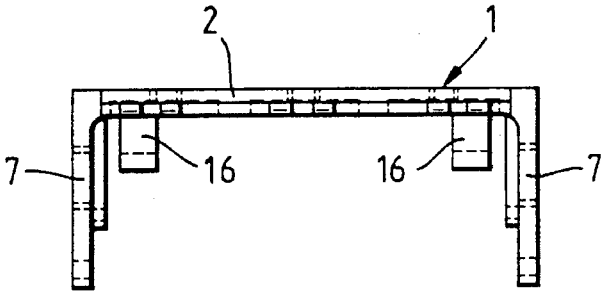
FIG. 2 is a plan view of the understructure of FIG. 1.
Figure 4:
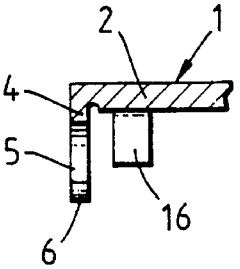
FIG. 4 is a view showing a section taken along the line IV—IV in FIG. 1.

In the shown embodiment an understructure 1 illustrated in FIGS. 1–4 has a rectangular, flat, substantially plan-parallel plate 2 with offset openings 3 in which, for mounting of the plate 2 on a wall or the like, the heads of mounting screws and additional washers can be inserted when needed. The plate 2 is provided on its lateral longitudinal edges with perpendicularly projecting, small, side walls 4 arranged parallel to one another. The side walls 4 are provided at their lower ends with substantially farther projecting carrying arms 5 with upwardly bent guiding projections 6 at their front ends as shown in FIG. 3. The upper ends of the side wall 4 are provided with arms 7 which project further and which have downwardly open U-shaped cutouts 8. Moreover, the arms 7 at their front, upper corners are provided with openings 9, and the plate 2 is provided at its upper, rear end with a plurality of cylindrical bearing pins 10 which are distributed over the whole width of the plate 2 as shown in FIG. 1. They are formed on the upper end of the plate 2 and form the upper limits of rectangular cutouts 11.

A recess 12 is formed in an upper, central portion of the plate 2, and its upper and lower edge is provided correspondingly with an undercut 13 and 14 as shown in FIG. 3. Furthermore, at the lower edge of the plate 2 and between the carrying arms 5, at least one elastically springy tongue 16 is arranged and provided with an undercut 15. Finally, at the inner side of at least one side wall 4, an elastically springing, resilient tongue 17 which forwardly projects from the side wall 4 and has a recess 18, is provided.

Figure 5:
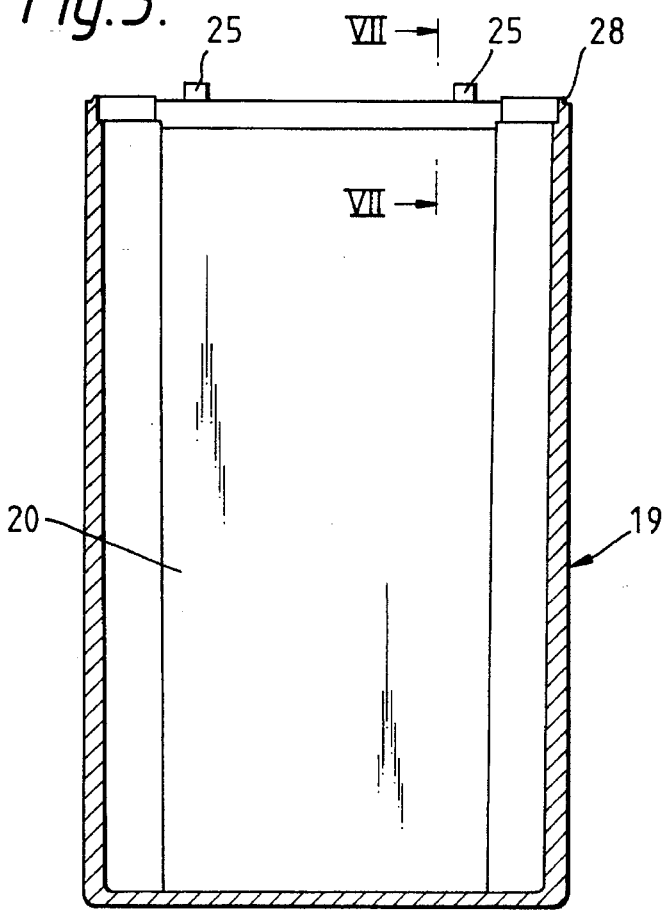
FIG. 5 is a view showing a longitudinal section through a waste container of the inventive arrangement, taken along the line V—V in FIG. 4.
Figure 6:
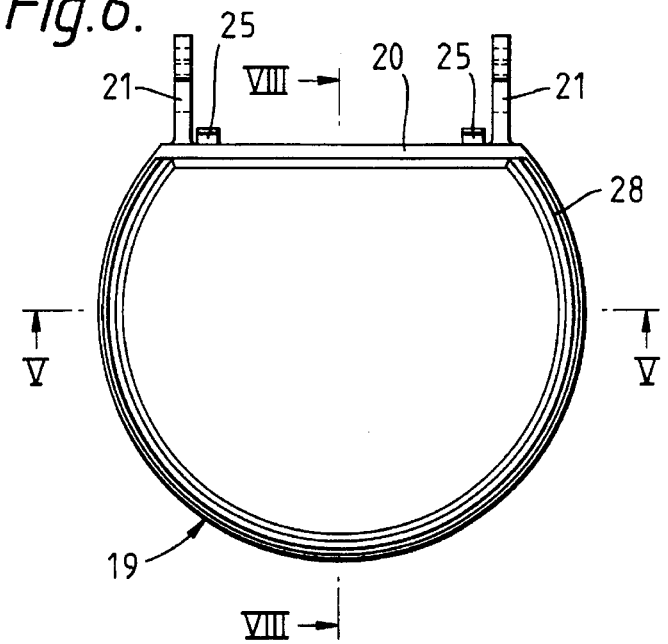
FIG. 6 is a plan view of the inventive waste container of FIG. 5.

A waste container 19 shown in FIGS. 5–8 is substantially cylindrical, but is also provided with a bottom and a flat rear wall 20 as can be seen in FIG. 6. Two plate shaped webs 21 extend perpendicularly rearwardly from the rear wall and are arranged at a distance corresponding to the distance between the carrying arms 5 and the arms 7 of FIG. 1. The holding webs 21 are provided at their lower ends with guiding surfaces 22 shown in FIG. 8. The guiding surfaces extend inclinedly upwardly and rearwardly from the rear wall 20 and end in downwardly oriented holding lugs 23 each forming an abutment at the lower end of the holding webs 21. At their upper ends the holding webs 21 each have a substantially perpendicularly upwardly extending guiding web 24 which has a width substantially corresponding to the width of the cutout 8 of FIG. 3.

Figure 25:
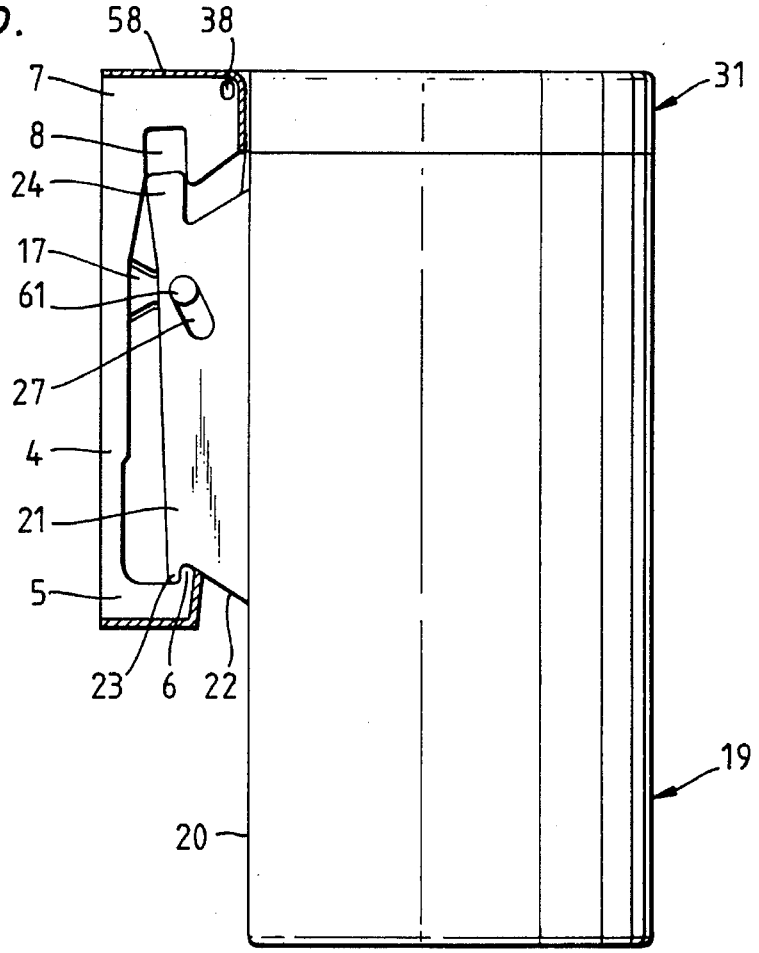
FIG. 25 is a view showing a section taken along the line XXV—XXV of FIG. 24 in the rest position of the waste container.
Figure 26:
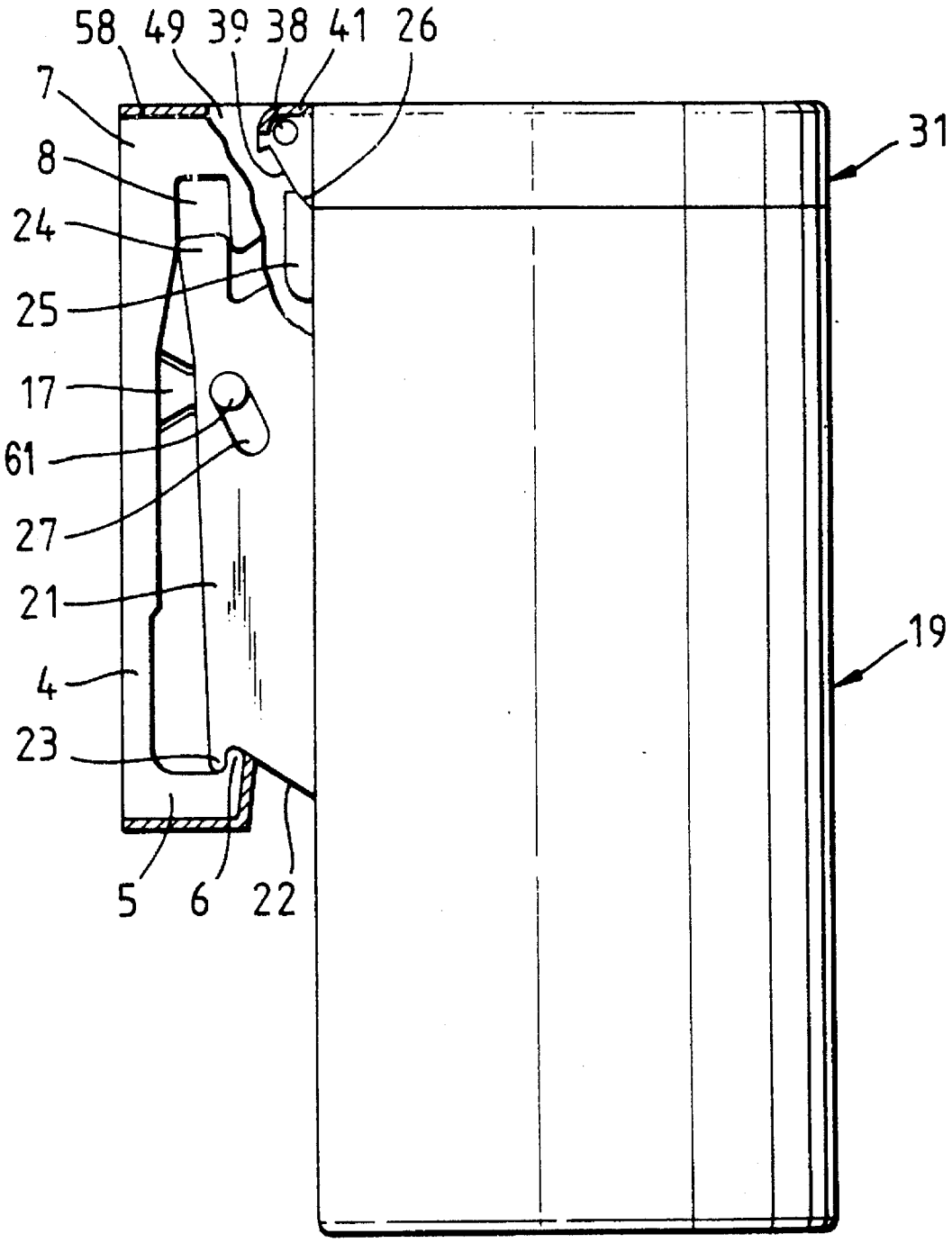
FIG. 26 is a view substantially corresponding to the view of FIG. 25, with a partial cutout for showing an opening mechanism for the cover of the waste container of the invention.

For mounting of the waste container 19 on the understructure 1, the holding webs 21 are suspended on the carrying arms 5 as shown in FIGS. 25 and 26 so that their holding lugs 23 engage behind the guiding projections 6 and abut against them. Thereby the holding webs 21 are not only held in the vertical direction, but also secured from pulling out forwardly. In addition, the height of the holding webs 21 is dimensioned so that the guiding webs 24, when the holding webs 21 are supported on the carrying arms 5 as shown in FIGS. 25, 26, are inserted with their upper ends just so deep into the cutouts 8 that the holding webs 21 are secured also at their upper ends from a withdrawal or an unintentional falling out from the understructure 1. The guiding webs 24 are arranged with such great distances from the rear wall 20, that the outer lower ends of the arms 7 shown in FIG. 7 of the understructure 1 occupy the space in the thusly formed intermediate chambers.

Figure 7:
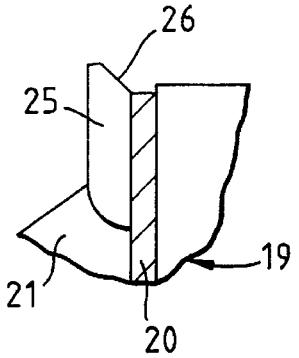
FIG. 7 is a view showing a section taken along the line VII—VII in FIG. 5.
Figure 9:
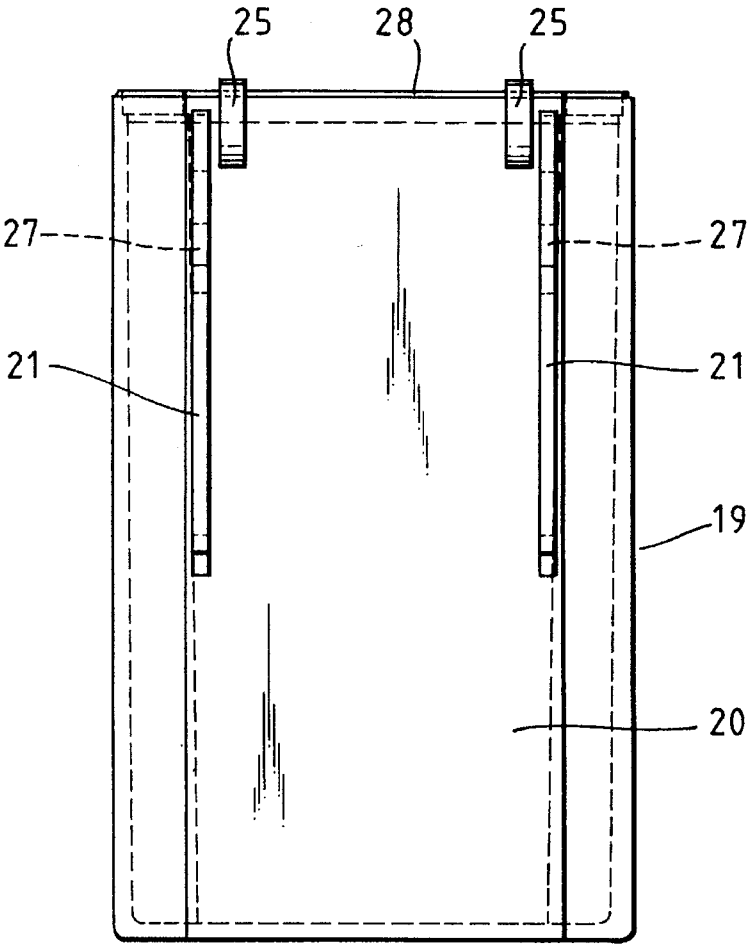
FIG. 9 is a view from below of the inventive waste container of FIG. 5.
Figure 8:
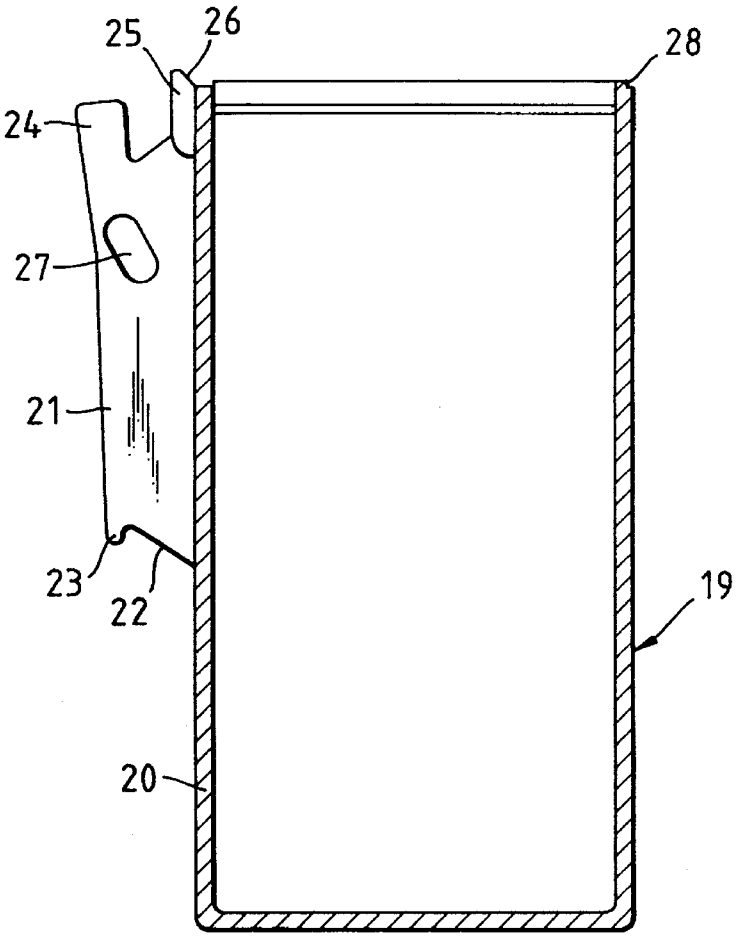
FIG. 8 is a view showing a section taken along the line VIII—VIII in FIG. 6.
Figure 10:
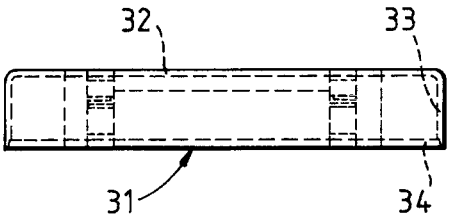
FIG. 10 is a front view of a cover for the inventive waste container of FIGS. 5–9.

The rear wall 20 at its upper end is provided with at least one actuating element 25 which projects beyond it and is formed as a small strip shown in FIGS. 7 and 8. The actuating element 25 at its upper end has preferably an inclinedly extending wedge surface 26 which forms an angle of for example 45° with the rear wall 20. It starts at the upper end and extends from there inclinedly upwardly and rearwardly. Two such actuating elements 25 are preferably provided and arranged between the holding webs 21 near them as shown in FIGS. 5 and 6.

An inclinedly extending slot 27 is provided in a central region of at least one holding web 21. It is arranged and formed so that during operation of the waste container 19 it is always oriented on the recess 18 of an associated springing, resilient tongue 17 of the understructure 1 shown in FIG. 3. Finally, the waste container 19 at its upper end is provided with a circumferential centering web 28 for a cover 31 which will be explained in detail with reference to FIGS. 10–14.

Figure 11:
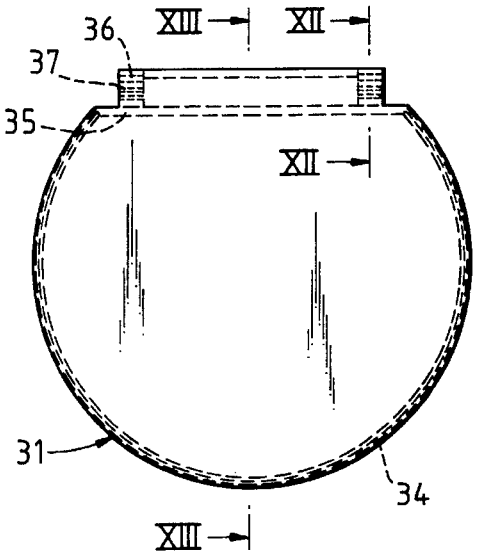
FIG. 11 is a plan view of the inventive cover of FIG. 10.
Figure 12:
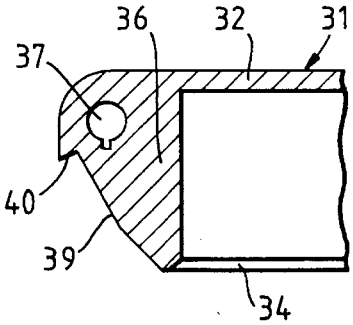
FIG. 12 is a view showing an enlarged section taken along the line XII—XII in FIG. 11.

The cover 31 shown in FIG. 11 has a cross-section corresponding to the cross-section of the waste container 19. It includes a cover body 32 and a cylindrical circumferential edge 33 extending downwardly from the cover body and provided at its lower end with a centering web 34 cooperating with the centering web 28 of FIG. 8. The edge 33 is formed as a flat rear wall 35 at the rear side of the cover 31. The dimensions of the cover 31 are selected so that in the closed condition it abuts with the centering webs 28, 34 centrally on the waste container 19 of FIGS. 25, 26 and the outer side of the edge 33 forms a flush extension of the outer casing of the waste container 19.

At least one downwardly extending projection 36 is arranged on the rear wall 35 of the cover 31 and has a transverse opening 37. A throughgoing bearing pin 38 of FIGS. 25, 26, can extend through the transverse opening 37, so as to engage with its ends into the openings 9 of the arms 7 shown in FIG. 3 and thereby to support the cover 31 turnably in the understructure 1. Preferably, two such projections 36 are provided and arranged at such a distance that with the mounted cover 31 they are located directly near the arms 7. In this case the throughgoing bearing pins 38 can be replaced by two short bearing pins extending through only the immediately adjacent openings 9, 37. Moreover, the openings 9 can be formed preferably as elongated holes for compensating structural tolerance deviations during the centering of the cover 31 on the waste container 19.

The projections 36 are provided at their rear sides with inclinedly extending sliding surfaces 39. The sliding surfaces form with the rear wall 35 of the cover 31 substantially the same angle as is formed by the sliding surfaces 26 of the waste container 19 shown in FIG. 8. They extend from the lower edge of the rear wall 35 inclinedly rearwardly and upwardly. The sliding surfaces 39 in this embodiment are arranged and formed so that with the cover 31 applied on the waste container 19 in correspondence with FIG. 26, they are at least partially supported on the wedge surfaces 26. The sliding surfaces 39 are provided at the rear ends with substantially vertically extending abutments 40 (see in particular FIG. 12), which cooperate with the actuating elements 25 of FIG. 27.

Figure 13:
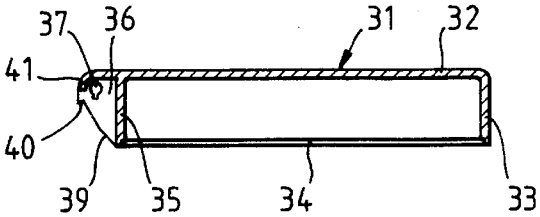
FIG. 13 is a view showing a section taken along the line XIII—XIII in FIG. 11.
Figure 14:
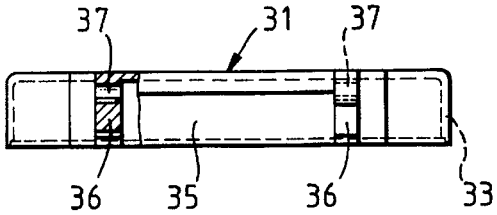
FIG. 14 is a partially sectioned rear view of the inventive cover of FIGS. 10–13.

The projections 36 are covered rearwardly by a cover 41 shown in FIG. 13. It has a portion located in the extension of the cover bottom 32 and a further portion which is bent downwardly. The width of the cover 41 substantially corresponds to the distance of the projection 36 shown in FIG. 14.

A cover cap 45 shown in FIGS. 15–20 is provided for covering the understructure 1 of FIGS. 1–4 and for lateral stabilization of the position of the waste container 19 in the understructure 1. It includes two parallel side walls 46 and 47 and a bottom 48 which extends perpendicularly to the walls. Moreover, intermediate walls 49 and 50 extend parallel to the side walls 46, 47 respectively, and the distance between the pair of the walls 46, 49 and 47, 50 in FIGS. 15 or 18, respectively, is insignificantly greater than the thickness of the side walls 4 of the understructure 1 and the corresponding thickness of the holding webs 21 of the waste container 19. The slots 51 formed by the walls 46, 49 and 47, 50 in FIG. 15 moreover have a central distance which corresponds to the central distance of the side walls 4 and the holding webs 21.

For mounting the cover caps 45 on the understructure 1, recesses 52 are formed in their bottoms 48 and serve for receiving the undercuts 15 of the springing tongues 16 of the understructure 1 shown in FIG. 3. Moreover, a transverse web 53 is provided in an upper part. It connects the intermediate walls 49 and 50 and is mounted on their rear sides. In a central part it is provided with two springing, resilient tongues 54, 55 which has undercuts. One of them can cooperate with the undercut 13 of FIG. 3 and the other can cooperate with the undercut 14 which are formed on the upper and lower edge of the recess 12 of the plate 2.

Figure 16:
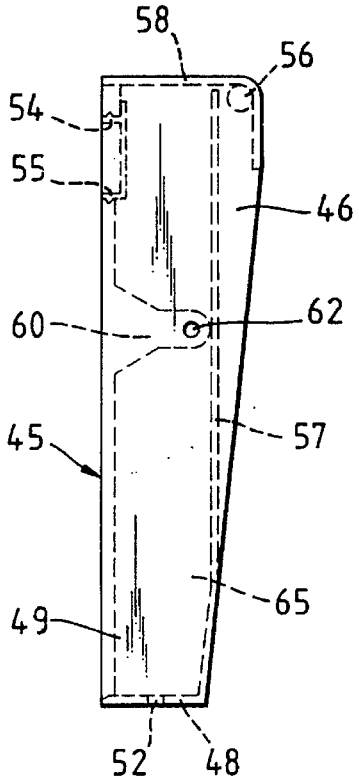
FIG. 16 is a side view of the inventive cover cap of FIG. 15.
Figure 19:
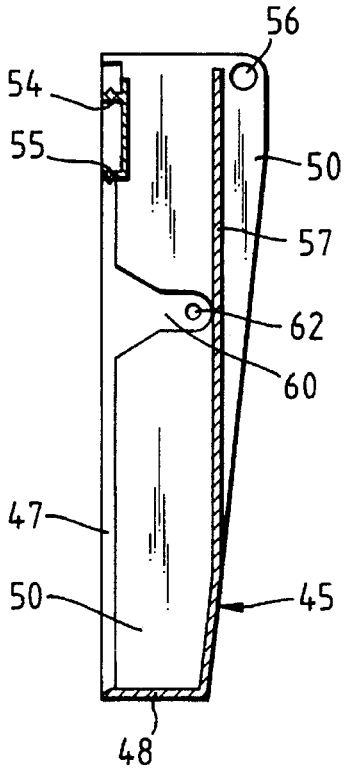
FIG. 19 is a view showing a section taken along the line XIX—XIX of FIG. 15.
Figure 20:
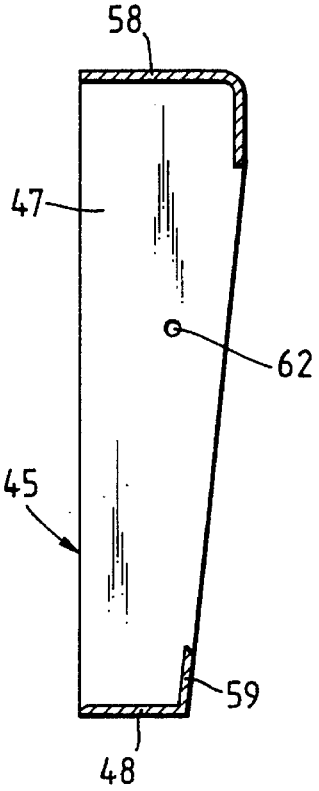
FIG. 20 is a view showing a section taken along the line XX—XX in FIG. 15.

An opening 56 shown in FIGS. 16 and 19 is formed in the front, upper corner of each intermediate wall 49, 50 for receiving the bearing pin 38 of FIGS. 25, 26. The openings 56 are formed preferably as elongated holes similarly to the openings 9. When a throughgoing bearing pin is utilized, at least one of the side walls 46, 47 must also be provided with such an opening.

For mounting of the waste container 19 on the understructure 1, first the cover cap 45 is placed on the understructure 1 mounted already on a wall or the like so that its carrying arms 5 and arms 7 are inserted in the slots 51 and the bottom 48 is arranged closely under the carrying arms 5. When the cover cap 45 is pressed in direction of the wall and the like, the undercuts 15 of the tongues 16 engage in the recesses 52 and the undercuts of the tongues 54, 55 behind the undercuts 13, 14, whereby the cover cap 45 is firmly seated on the understructure 1. The rear side edges of the side walls 46, 47 and the bottom 48 form for example a flat surface for tight abutment against the wall or the like, on which the understructure 1 is mounted by the openings 3.

A recess 60 shown in FIGS. 16, 19 is provided in each intermediate wall 49, 50 of the cover cap 45 at the location where during their placement on the understructure 1 the tongues 17 are located. Thereby it is possible to arrange the tongues 17 so that after the completed mounting of the waste container 19, they are arranged directly on the inner sides of their holding webs 21 and in the region of their slots 27 shown in FIG. 8. Anti-theft securing elements 61 formed as transverse pins with pin-shaped or disc-shaped heads are plugged into the recesses 18 of the tongues 17 shown in FIG. 3 before the mounting of the cover cap 45 and the waste container 19. This is shown schematically in FIGS. 25 and 26. Preferably, they are secured in the recesses by snap connections and the like.

The holding webs 21 of the waste container 19 are inserted in the slots 51 so that the guiding webs 24 of FIG. 8 engage in the cutouts 8 of FIG. 3. Thereafter the waste container 19 is somewhat lowered for placing the lower end of the holding webs 21 on the carrying arms 5 of FIGS. 25, 26 so that the holding lugs 23 engage behind the guiding projections 6 and the waste container 19 assumes a rest position in the understructure 1. The holding webs 21 during their insertion into the slots 51 press first the tongues provided on the understructure 1 as shown in FIG. 3, or the heads of the anti-theft securing elements 61 inserted in the recesses 18, which heads are provided with wedge-shaped insertion inclines laterally inwardly, until they extend in the region of the slots 27 and the resiliently engage in the slots. The waste container 19 can now only be withdrawn again from the cover cap 45 by inwardly pressing simultaneously the tongues 17, by means of a steel pin or the like which as projected through a small, almost invisible opening 62 shown in FIGS. 15, 16 and arranged in the side wall 46 and/or 47.

The cover 31 is mounted before or after the mounting of the waste container 19. The respective bearing pins 38 are inserted from the side through the openings 56 of the cover cap 45 into the openings 9 of the understructure 1 shown in FIG. 1. For this purpose preferably special bearing pins 38 are utilized, which for example are arrestable, for at least making difficult a dismounting of the cover 31 by unauthorized persons.

Figure 15:
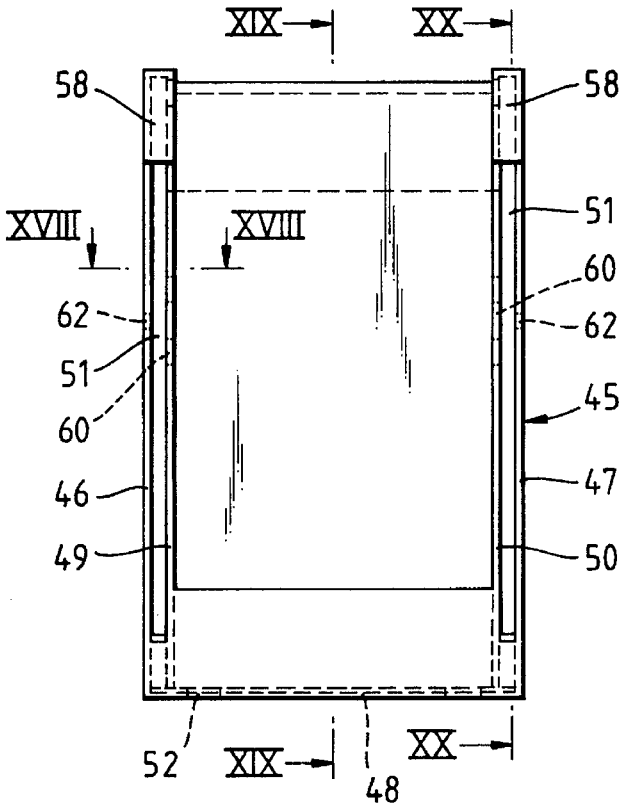
FIG. 15 is a front view of a cover cap for the understructure of FIGS. 1–4.

The front side of the cover cap 45 is covered with a front wall 57 which extends in correspondence with FIGS. 16 and 19 substantially parallel to the rear side edges of the side walls 46, 47 and the bottom 48. Moreover, the slots 51 shown in FIG. 15 are covered at their upper and lower ends by cover strips 58, 59 which can be seen from FIG. 20.

Figure 17:
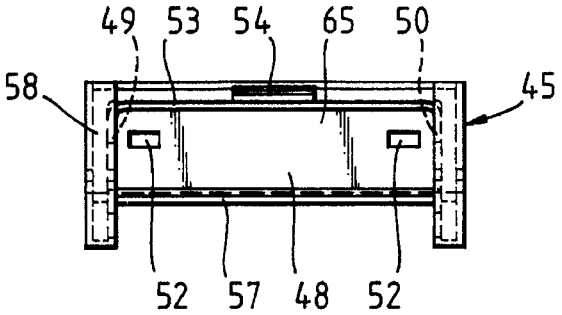
FIG. 17 is a plan view of the inventive cover cap of FIG. 15.
Figure 18:
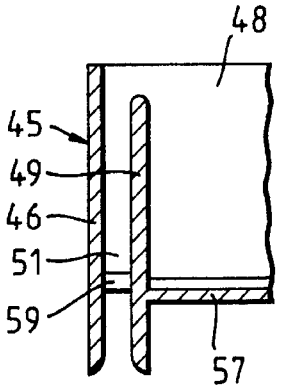
FIG. 18 is a view showing a section taken along the line XVIII—XVIII in FIG. 15.
Figure 21:
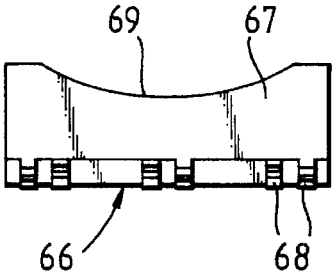
FIGS. 21–23 is correspondingly a view from below, a side view and a front view of a cover for an additional supply container limited by the cover cap of FIGS. 15–20.
Figure 22:
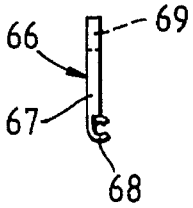
Figure 23:
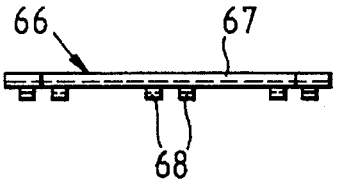

As shown in FIG. 17, the bottom 48, the intermediate walls 49, and 50 and the wall or the like on which the understructure 1 is mounted form an upwardly open hollow chamber which is substantially parallellepiped-shaped and serves as supply container 65 for special hygiene bags. The supply container 65 is closed from above by a further cover 66 shown in FIGS. 21–23. The cover 66 substantially consists of a cover plate 67 provided at its reverse side with slotted bearing ears 68 shown in FIG. 22. They are arranged at the same distances as the bearing pins 10 of the understructure 1 shown in FIGS. 1 and 3 and can be clamped on them for mounting the cover 66 turnably on the understructure. The bearing ears 68 can extend at least partially into the cutouts 11 shown in FIG. 1. The cross-section of the cover plate 67 corresponds substantially to the cross-section of the upper end of the supply container 65. Preferably, the cover plate 67 is provided with a recess 69. The recess can serve on the one hand as a gripping trough during the actuation of the cover 66, and on the other hand releases the observation of the user of the waste container 19 for the interior space of the supply container 65 and the hygiene bags accommodated in it.

Figure 24:
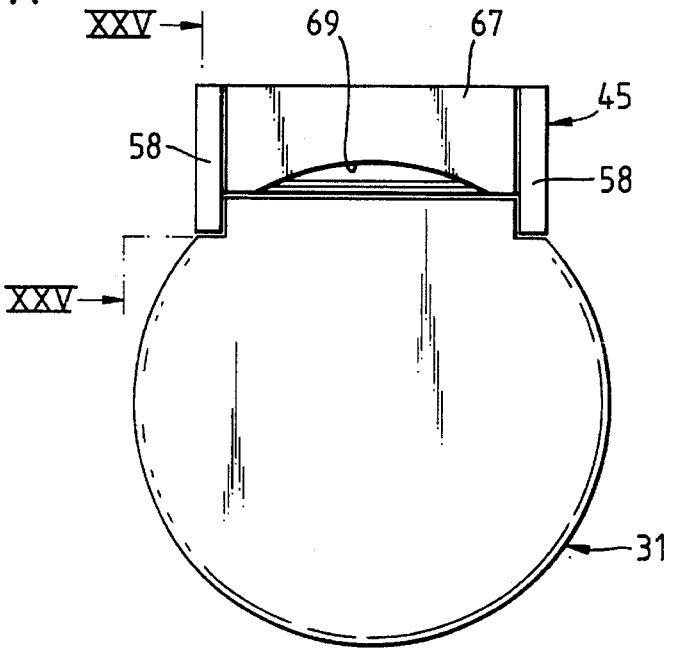
FIG. 24 is a plan view of the inventive arrangement in mounted condition with the closed cover.

The operation of the cover-opening mechanism for the above described waste container 19 is illustrated with reference to FIGS. 24–27:

In the rest position of the waste container 19 suspended on the understructure 11 as shown in FIGS. 24, 25, the cover 31 is located in its closing position. The holding lugs 23 engage behind the guiding projections 6 while the guiding webs 24 extend somewhat into the cutouts 8. Simultaneously, an undesired or unintentional withdrawal of the waste container 19 from the understructure 1 forwardly is prevented by the anti-theft securing elements 61. Toward the sides, the waste container 19 is substantially immovable, since its holding webs 21 are held in the slots 51 of the cover cap 45 shown in FIG. 15. Even if the parts 13, 14, 15, 52, 54, and 55 only form snap connections the cover cap 45 cannot be dismounted in the suspended condition of the waste container 19. In the rest position the sliding surfaces 39 of the cover 31 lie at least partially on the wedge surfaces 26 of the waste container 19 as shown in FIG. 26.

Figure 27:
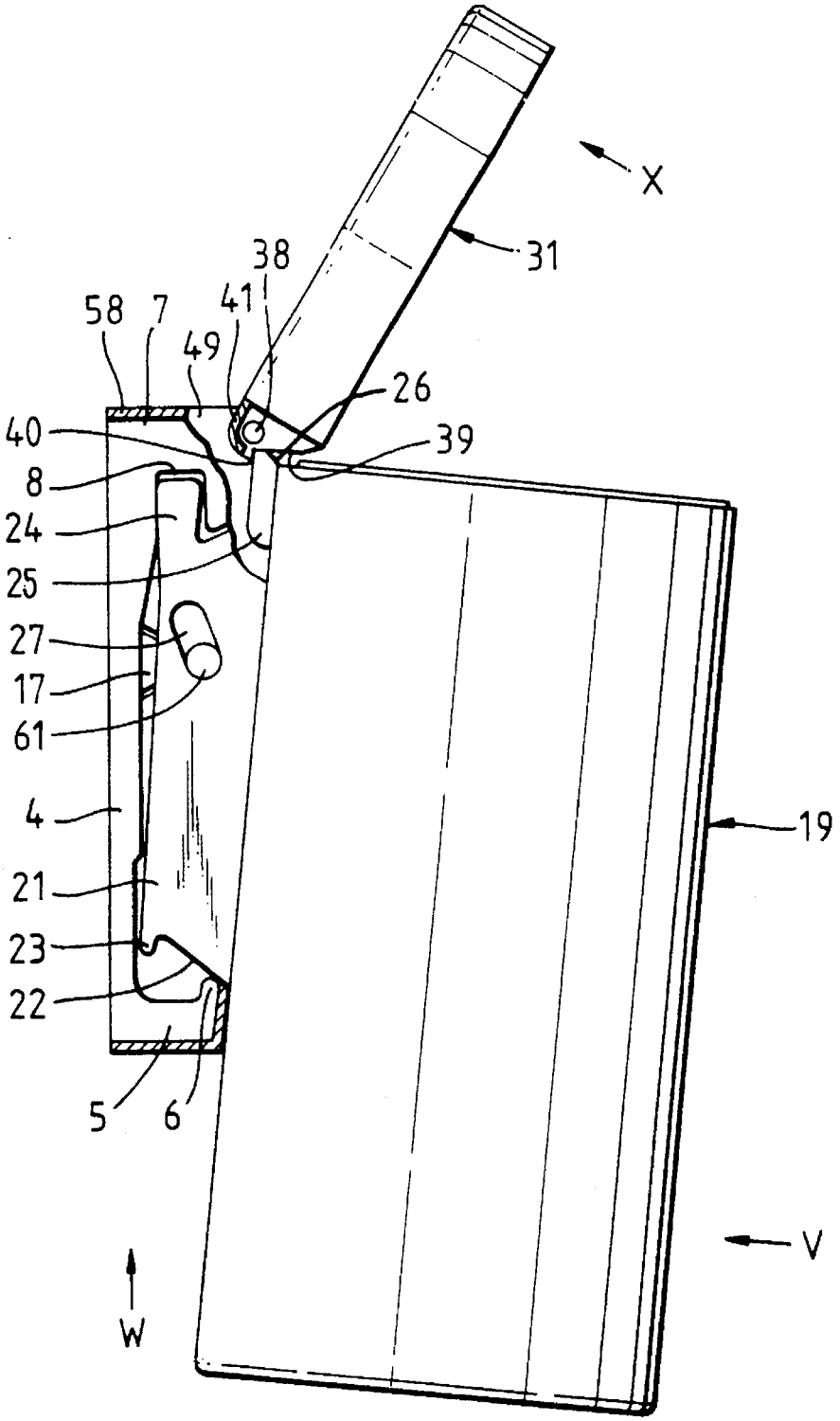
FIG. 27 is a view corresponding to the view of FIG. 25, but in an open position of its cover produced by turning of the waste container.

The opening of the cover 31 the waste container 19 is turned in correspondence with FIG. 27 in its lower region in direction of an arrow v. This can be performed preferably by hand, but also for example with the knee, for which purpose the waste container 19 is arranged preferably at the knee height. Due to this turning the guiding surfaces 22 move in correspondence with FIG. 27 along the guiding projection 6, and the waste container 19 is somewhat lifted in direction of an arrow w and simultaneously the guiding webs 24 engage deeper into the cutouts 8. As a result of this movement, the wedge surfaces 26 or the upper ends of the actuating element 25 act on the sliding surfaces 39 of the cover 31, and therefore it is turned upwardly around the spatially fixed axis of the bearing pin 38 in direction of an arrow x with opening of the waste container 19. The turning performed in the lower region of the waste container 19 in direction of the arrow v has also the advantageous action in that the container opening released from the cover 31 is turned in direction toward the user. When the waste container 19 is subsequently released, a gravity force then acts so that the above described steps are performed in a reverse sequence to reach again the rest position of FIGS. 24–26.

The turning movement of the waste container 19 which is required for opening of the cover 31 can amount to only several degrees, which can be provided by a corresponding dimensioning of the side walls 46, 47 and the front wall of the cover cap. In order to provide an automatic closing of the cover 31 after the release of the waste container 19, the position of the abutment 40 shown in FIG. 27 is preferably selected so that the cover 31 can be opened widely enough, but due to the abutting of the abutment 40 against the actuating element 25 in no case reaches the 90° position or can be turned outwardly beyond this position. Moreover, the length of the slots 27 is selected so that the waste container 19 can perform the above described turning movements.

In addition, it is of course possible to lift the cover 19 by hand without turning the waste container 19, and therefore turn it over the 90° position outwardly, since in the rest position of the waste container 19 the abutments 40 remain outside of engagement of the actuating element 25.

When the waste container 19 is to be emptied, a steel pin is inserted from outside into the opening 62 shown in FIGS. 15, 16 when the waste container is in the lifted position of FIG. 27, so that the pin presses the anti-theft securing element 61 outwardly from the slots 27. After this the waste container 19 is turned forwardly against the arrow v, whereby first the holding lugs 23 are pulled over the guiding projections 6 and of the slots 51 of the cover cap 45 and then the guiding webs 24 can be withdrawn downwardly from the cutouts 8.

The above described embodiment is not of course limiting and can be modified in many ways. This is especially true for the construction, number and arrangement of different parts of the opening mechanism for the cover 31. In addition, it is also possible to form the lower part of the understructure 1 for example as an angle piece so that its one leg can be mounted on the ground instead of the wall. The waste container 19 and the remaining above described parts can be produced for example of synthetic plastic material in an injection molding process.

It will be understood that each of the elements described above, or two or more together, may also find a useful application in other types of constructions differing from the types described above.

While the invention has been illustrated and described as embodied in an arrangement with a waste container, a cover and a cover opening mechanism, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. An arrangement for storing wastes for household and sanitary applications, comprising: an understructure which is mountable to a wall, said understructure having at a lower portion thereof guiding projections and at an upper portion thereof arms being provided with invented U-shaped cutouts; a waste container being provided at a rear and lower side thereof with inclined guide surfaces for cooperation with said guiding projections, at a rear end upper portion thereof with guiding webs for insertion into and cooperation with said U-shaped cutouts, and with at least one actuating element; and a cover for closing said waste container in a rest position, said cover being turnably mountable in said understructure around an axis and having a sliding surface for cooperating with said actuating element; wherein said waste container and said cover are so mountable in said understructure that in said rest position said guiding surfaces rest on said guiding projections, said guiding webs project into said cutouts and said cover closes said waste container, and that by turning said waste container the guiding surfaces are moved along said guiding projections for also lifting said waste container such that said actuating element acts onto said sliding surface of said cover, turns said cover around said axis and thus opens said waste container, and that waste container and said cover are moved back to said rest position by gravity force when said waste container is subsequently released after said turning and lifting movement.

2. An arrangement as defined in claim 1, wherein said cover has at lest one abutment which limits an opening movement of said cover during turning of said waste container.

3. An arrangement as defined in claim 1, wherein said understructure further comprises carrying arms having guiding projections, and wherein said waste container further comprises a rear side having holding webs, said holding webs having holding lugs at lower ends thereof, said holding lugs being engaged behind said guiding projections in said rest position.

4. An arrangement as defined in claim 1; and further comprising a cover cap for covering said understructure.

5. An arrangement as defined in claim 4, wherein said cover cap has a bottom, intermediate walls and a front wall which together limit a supply container.

6. An arrangement as defined in claim 5; and further comprising a further cover provided with said supply container and turnably supported on said understructure.

7. An arrangement as defined in claim 1; and further comprising a cover cap for covering said understructure, said cover cap having slots for laterally guiding said holding webs in said understructure.

8. An arrangement as defined in claim 7, wherein said understructure has at least one anti-theft securing element which is mounted on a resilient tongue, at least one of said holding webs having a slot in which said anti-theft securing element is arrestable.

9. An arrangement as defined in claim 8, wherein said cover cap has an opening for removing said anti-theft securing element from said slot.

* * * * *